US005111860A

United States Patent [19]

Wingate-Hill et al.

[11] Patent Number: 5,111,860

[45] Date of Patent: May 12, 1992

[54] COMPRESSION LOG DEBARKING APPARATUS

[75] Inventors: Robin Wingate-Hill, Greenleigh; Ian J. MacArthur, Bungendore, both of Australia

[73] Assignee: Commonwealth Scientific and Industrial Research Organisation, Australia

[21] Appl. No.: 681,420

[22] Filed: Mar. 27, 1991

Related U.S. Application Data

[60] Division of Ser. No. 457,902, Dec. 27, 1989, Pat. No. 5,022,446, which is a continuation-in-part of Ser. No. 260,551, Oct. 20, 1988, abandoned.

[30] Foreign Application Priority Data

Oct. 20, 1987 [AU] Australia ..... PI4967

[51] Int. Cl.[5] ..... B27L 1/00

[52] U.S. Cl. ..... 144/208 F; 144/208 R; 144/341; 144/246 C; 144/246 E; 144/249 A; 144/249 B

[58] Field of Search ..... 144/208 R, 208 F, 208 G, 144/340, 341, 246 R, 246 G, 246 E, 249 R, 249 A, 249 B

[56] References Cited

U.S. PATENT DOCUMENTS

| | | | |
|---|---|---|---|
| 2,945,523 | 7/1960 | Jenkins | 144/208 F |
| 3,263,720 | 8/1966 | Brock et al. | 144/208 F |
| 3,587,685 | 6/1971 | Morey | 144/208 F |
| 3,774,660 | 11/1973 | Morey et al. | 144/208 F |
| 4,396,048 | 8/1983 | Dubey | 144/208 F |

*Primary Examiner*—W. Donald Bray
*Attorney, Agent, or Firm*—Sughrue, Mion, Zinn, Macpeak & Seas

[57] ABSTRACT

Apparatus for debarking a log using the compression debarking technique includes rollers which apply radial pressure to the log to separate the bark from the wood of the log. Three double-cone rollers, each having its double cones tapered to the middle of the roller, are arranged with their axes of rotation at substantially 60° to each other and perpendicular to the direction of travel of the log through an aperture defined by the three rollers. Pressure is applied to the bark of the log by the double-cone rollers. The apparatus may include cutting means, such as a knife blade on the outer surface of all three of the double-cone rollers, which slices the bark which has been separated from the wood of the log by the pressure applied by the rollers, so that strips of bark fall from the log. The invention is especially suitable for removing thick stringy, fibrous bark from logs.

9 Claims, 3 Drawing Sheets

COMPRESSION LOG DEBARKING APPARATUS

CROSS-REFERENCE

This is a divisional application of U.S. patent application Ser. No 07/457,902, filed Dec. 27, 1989, now U.S. Pat. No. 5,022,446, which is as a continuation-in-part application in respect of U.S. patent application Ser. No. 07/260,551, filed Oct. 20, 1988, and now abandoned.

TECHNICAL FIELD

This invention concerns the removal of bark from logs by a compression debarking technique. It is particularly suitable for the removal of bark from eucalypt logs having thick, stringy, fibrous bark which cannot be removed effectively by other debarking mechanisms.

BACKGROUND TO THE INVENTION

A number of techniques have been used to remove bark from logs. Apparatus adopting those techniques includes (i) debarkers using rollers with projecting teeth, (ii) drum debarkers, (iii) rotary or ring debarkers, (iv) compression log debarkers, (v) hydraulic debarkers, and (vi) flail debarkers.

There are several realisations of debarkers which use rollers carrying teeth on their outer surfaces. The teeth are designed and positioned to rip pieces of bark from a log passing between the rollers until all the bark is removed. Examples of such debarkers are described in the specifications of U.S. Pat. Nos. 3,363,720 (to G W Brock and H J Merrifield) and 3,587,685 (to N K Morey and L N Smith).

A similar approach to log debarking is found in the drum debarkers. With a drum debarker, logs are passed through a rotating drum which has internal vanes or ribs. As the logs are tumbled within the drum, they strike each other and the vanes or ribs within the drum, and these impacts act to tear the bark from the logs. Descriptions of drum debarkers are found in the book entitled "Handbook of Pulp and Paper Technology" (second edition), edited by K W Britt and published by Van Nostrand Reinhold Company, at pages 103 and 122, and also in the book entitled "Forest Products, their Sources, Production and Utilization", by Panshin, Harrer, Bethel and Baker, published by McGraw-Hill Book Company (second edition, 1962), at pages 332 to 335. Such drum debarkers are unsuitable for debarking logs of stringy-bark eucalypts and other species having thick, stringy, fibrous bark.

The rotary or ring debarkers—a number of models have been used—cut the bark with a knife before it is stripped from a log. A typical ring debarker has a hollow rotor unit within which are mounted inwardly projecting cutters or barking tools. The cutters or barking tools are rotated about a log as it is moved through the rotor to cut or strip the bark from the log. Examples of developments in rotary debarkers are found in the specifications of Australian patents Nos 479,105 (to Kokum Industri Aktiebolag), 501,776 (to V L Valo) and 575,736 (to Fuji Kogyo KK) and Australian patent application No 21267/83 (to Hutson), which lapsed without a patent being granted on it.

A third log debarking technique, known as compression debarking, which is suitable for removing bark from stringy-bark eucalypts, involves the application of pressure to the bark of a log, to break the bond between the bark and the wood and leave a tube of bark surrounding, but separated from, the wood. The tube of bark is then cut into strips by a knife, which is typically mounted on a roller downstream from the pressure-applying rollers, although the cutting of the bark may occur before, during or after the application of pressure to the bark. Examples of this type of debarker are described in the specification of Australian patent No 604,514 in the name of Commonwealth Scientific and Industrial Research Organisation, and in the specification of the corresponding U.S. Pat. No. 4,875,511.

Other debarking techniques include hydraulic barkers using water jets under high pressure, flails (see the specification of Australian patent No 506,204 to L J Emmins), "knocking" the bark from a log (see the specification of Australian patent No 511,333 to G A Williames) and, of course, manual removal of the bark with axes and the like.

The present invention concerns the third debarking technique referred to above, compression debarking.

Two recent proposals for an improved approach to compression debarking by this technique were the subject of the Australian patent application (No 82427/87) upon which the aforementioned Australian patent No 604,514, in the name of Commonwealth Scientific and Industrial Research Organisation, was granted.

One of those proposals (excluded from the specification of application No 82427/87 by amendment and thus not featured in the specification of Australian patent No 604,514) involves the passage of a log through an open-ended passage defined by three rollers which are mounted on a frame with their axes of rotation arranged angularly relative to each other and to the elongate direction of the passage. Thus, instead of being parallel to each other, the axes of the rollers are skewed relative to the elongate direction of the passage and the rollers define a tapered or converging passage. The rollers all rotate in the same direction (they may be rotated at different speeds), and at least two of the rollers are mounted resiliently on their support frame, to enable the cross-sectional dimension of the passage to change to allow logs of various size to be debarked. The cylindrical outer surface of each roller is grooved or is otherwise roughened, or is provided with welded-on bars or the like, to enable a log to be gripped by the rollers.

A log that is to have its bark removed is fed endwise into the passage and passes through it under the influence of the grip on the log by the outer surfaces of the rollers combined with the rotation of the rollers. As the log is drawn through the tapered passage, it is subjected to increasing radial compressive forces, and these forces cause the bark to separate from the wood of the log. One of the rollers is provided with a circumferential "knife" on its outer surface, to cut through the loosened bark which would otherwise tend to remain as a tube around the body of logs of rough, stringy-barked eucalypts and the like.

The second proposal disclosed in the specification of the aforementioned Australian patent application No 82427/87 (now the sole subject matter of Australian patent No 604,514 and U.S. Pat. No. 4,875,511) involves the provision of at least two pairs of rollers, each pair mounted with the axes of its rollers parallel to each other, and at an angle to the axial direction of the other pair of rollers. The outer surface of each roller is concave, and the pairs of rollers are mounted in spaced apart relationship along the path followed by a log—one pair of rollers thus being effectively downstream of the other pair of rollers if the debarking apparatus contains only two pairs of rollers. A log to be de-barked is passed between the rollers of the first pair, then through the second pair of rollers (and then between other pairs of rollers, if present).

The rollers of at least the first pair are grooved or otherwise roughened to provide a firm grip on a log. Each roller of the final two pairs of rollers is provided with one or more helically-mounted knife blades on its outer surface. When a log to be debarked is fed into the first pair of rollers, the first rollers apply a compressive force to the log to such an extent that the bond between the bark and the wood is broken and the bark separates from the timber body of the log. The bark remains as a tube of enlarged cross-section around the timber body. The knife blades affixed to the rollers cut the tubular bark into strips, which fall from the log.

This arrangement is effective with logs having a substantially uniform cross-section with a diameter approximately equal to twice the radius of curvature of the concave shape of the rollers. However, problems are experienced when the logs are not essentially circular in cross-section and when the logs have large branch stubs and other irregularities, which tend to block the forward movement of the log through the pairs of rollers.

DISCLOSURE OF THE PRESENT INVENTION

It is an object of the present invention to provide an improved form of compression debarking equipment.

This objective is achieved by providing compression log debarking equipment having three rollers, each roller being shaped as a double cone with the cones thereof tapering to the center of the roller, the three rollers defining a hexagonal aperture through which a log may pass. The rollers are mounted on a framework in spaced apart relationship in the direction of travel of a log through the equipment. One of the double-cone rollers has a fixed location on the framework, while the other two double-cone rollers are moveable along respective arms of the framework. The mounting of the rollers on the arms of the framework is such that the axis of rotation of each moveable roller is at about 60° relative to the axis of rotation of the fixed roller and is also at about 60° relative to the axis of rotation of the other moveable roller. Each moveable roller is mounted on a roller support member that is adapted to be moved in a direction perpendicular to its axis. A guide roller is associated with each moveable roller. Each guide roller will normally (but not necessarily) be a conventional cylindrical roller, mounted on the framework of the equipment, with its axis of rotation in the same plane as its associated moveable roller but adapted for movement in a direction parallel to the direction of movement of the other moveable roller relative to the framework. Movement of the moveable rollers and their associated guide rollers is used to apply pressure to the log, to separate the bark from the underlying timber. The movement of the moveable double-cone rollers also results in pressure being applied to the log by the fixed double-cone roller.

The double-cone rollers may all be driven, to propel a log through the equipment. Normally each double-cone roller will be provided with a cutting edge or knife blade on its outer surface, to cut through the bark of the log, although separate bark-cutting equipment may be used in the debarker.

Thus, according to the present invention, there is provided equipment for removing the bark from a log by the compression debarking technique, the equipment comprising a) a framework;

b) a first roller, fixedly mounted on the framework;

c) second and third rollers mounted on the framework for linear movement thereon, said second and third rollers being mounted in spaced apart relationship in the direction of movement of the log through the equipment, the axis of rotation of each roller being perpendicular to the direction of movement of a log through the equipment and at an angle of substantially 60° relative to the axes of rotation of each of the other rollers; the first, second and third rollers each being in the form of a double cone, the cones of each roller being tapered towards the middle of the roller;

d) a pair of guide rollers mounted on the framework, each guide roller being associated with a respective one of the double-cone second and third rollers and having its axis of rotation substantially perpendicular to the direction of movement of the log through the equipment and substantially perpendicular to the axis of rotation of the first double-cone roller, each guide roller being adapted for linear movement on the framework in a direction parallel to the direction of movement of the second or third double-cone roller with which it is not associated;

e) respective movement means to move said second and third rollers and said guide rollers linearly on said framework and to cause said second and third rollers and said guide rollers to apply pressure to said log;

f) motor means for rotating said first, second and third rollers; and g) cutting means to cut the bark of said log.

These and other features of the debarking equipment of the present invention will be more clearly understood from the following description of an embodiment of the present invention, which is provided by way of example only. In the following description, reference will be made to the accompanying drawings.

DETAILED DESCRIPTION OF THE ILLUSTRATED EMBODIMENT

FIGS. 1(*a*)'–1(*f*)' as indicated above, illustrates the roller configurations used in the present invention, in the equipment described in the specification of Australian patent application No 82427/87, and in the equipment of aforementioned U.S. patent application Ser. No 07/457,902 (now U.S. Pat. No. 5,022,446). Each pair of drawings in FIG. 1 illustrate an end view of, and a view from above, a log passing through compression debarking equipment and having its bark removed. Specifically, FIGS. 1(*a*), 1(*b*) and 1(*c*) show equipment in which the log is rotated about its long axis as it passes through the compression debarking equipment, and FIGS. 1(*d*), 1(*e*) and 1(*f*) illustrate the roller arrangements of compression debarking equipment in which the log is debarked without rotation of the log about its long axis. The arrangements of FIGS. 1(*a*), 1(*d*) and 1(*e*) are those described in the A-publication of the specification of Australian patent application No 82427/87. The arrangements shown in FIGS. 1(*b*) and 1(*c*) are those featured in U.S. patent application Ser. No. 07/457,902, of which the present application is a divisional application. The roller arrangement of FIG. 1(*f*) is that used in the present invention.

Figure 1A:
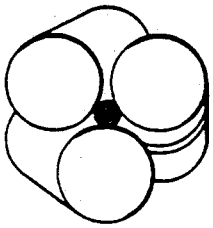
FIG. 1a PRIOR ART
FIGS. 1(*a*) through 1(*f*) illustrate the roller arrangements of the present invention and of the inventions described in the specification of the aforementioned Australian patent application No 82427/87.
Figure 1B:
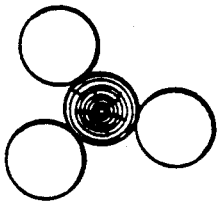
Figure 1C:
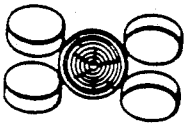
Figure 1D:
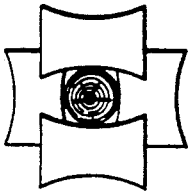
FIG. 1d PRIOR ART
Figure 1E:
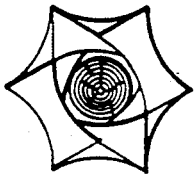
FIG. 1e PRIOR ART
Figure 1F:
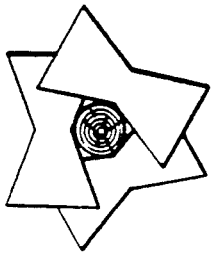
Figure 1A:
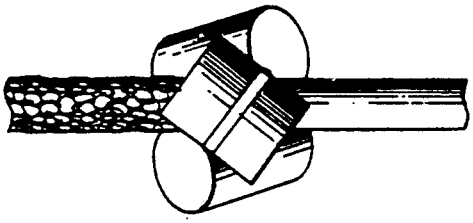
Figure 1B:
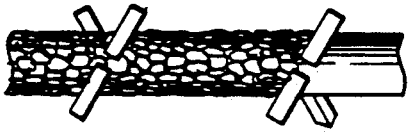
Figure 1C:
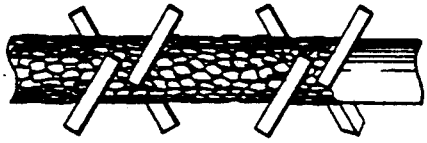
Figure 1D:
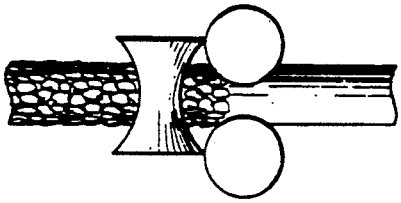
Figure 1E:
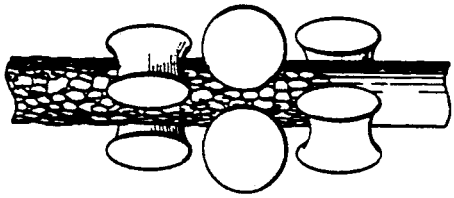
Figure 1F:
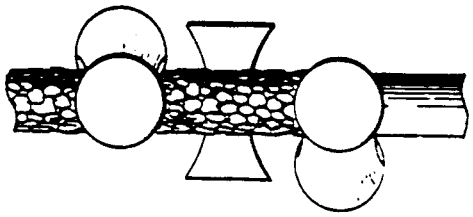
Figure 2:
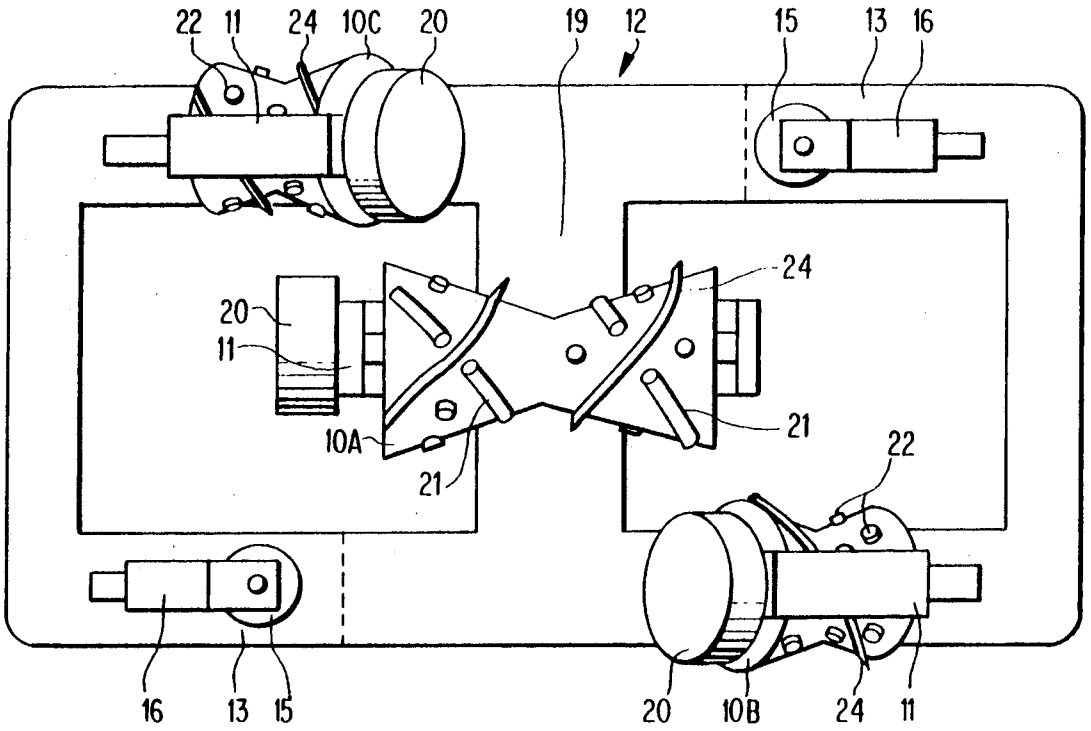
FIG. 2 is a partly schematic plan view of one embodiment of the present invention.
Figure 3:
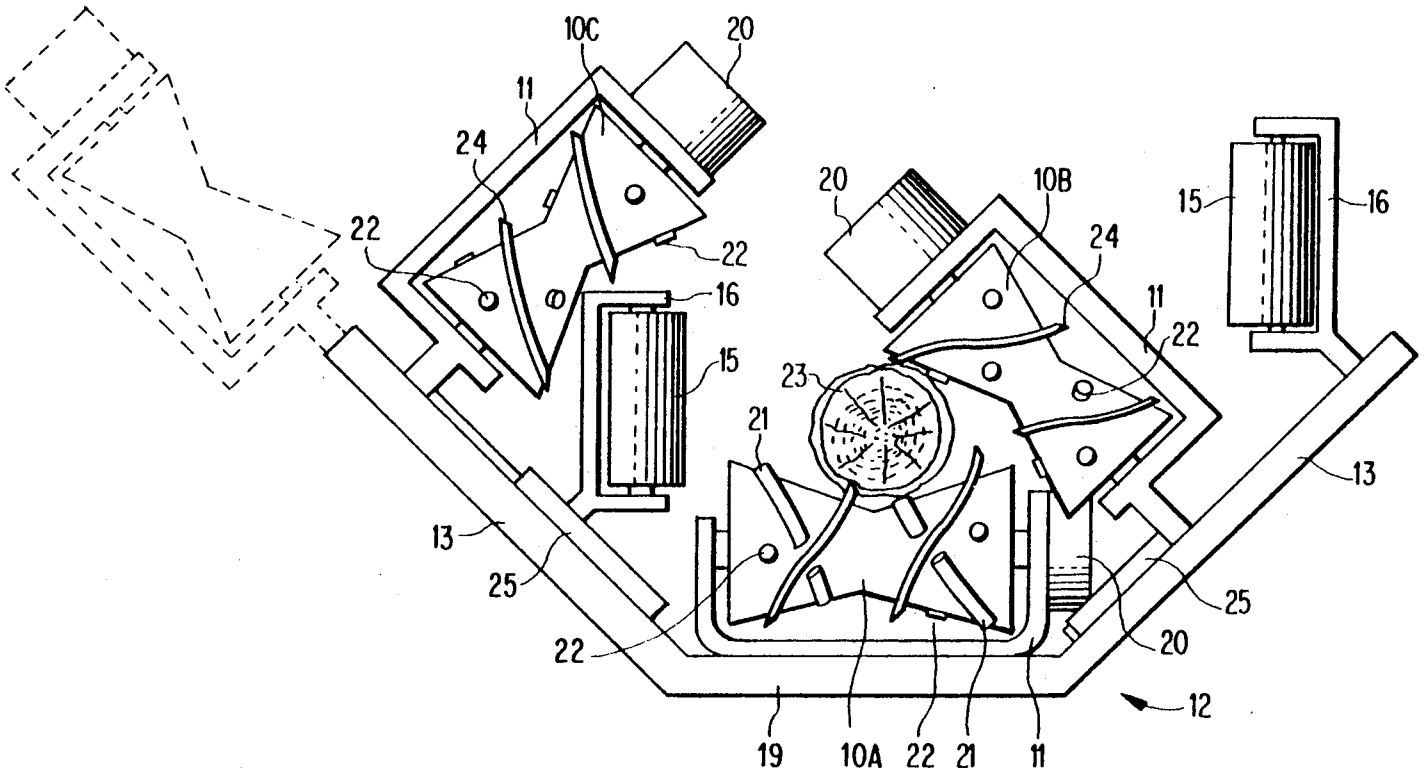
FIG. 3 is a partly schematic end view of the embodiment of FIG. 2, taken in the direction of travel of a log through the equipment, but with the moveable double-cone rollers (and their associated guide rollers) removed from the log for the convenience of illustrating the mounting of the rollers.

The equipment illustrated in FIGS. 2 and 3 is one example of the present invention. This equipment uses three double-cone rollers 10A, 10B and 10C, each supported in a respective mounting bracket 11, and driven by an associated motor 20. Each motor 20 is preferably a reversible hydraulic motor, examples of which are well known in this art.

The roller 10A is fixedly mounted on the central frame member 19 of the framework 12 of the equipment. The framework 12 includes a plurality of side arms 13, extending from the central frame member 19 to form a generally V-shaped structure. The brackets 11 supporting the second and third double-cone rollers, 10B and 10C respectively, are mounted (in known manner) for travel along their associated side arms 13 on opposed sides of the framework of the equipment under the influence of respective hydraulic rams 25 or their mechanical equivalents. The axes of rotation of the double-cone rollers 10B and 10C are at substantially 60° relative to the axis of rotation of the double-cone roller 10A. The outer surfaces of the rollers 10A, 10B and 10C are preferably roughened or provided with welded-on bars 21 or spikes 22 to enable the rollers to "grip" a log passing through the pressure debarking equipment.

Each of the second and third rollers 10B and 10C has an associated guide roller 15. Each guide roller 15 of the embodiment illustrated in FIGS. 2 and 3 is a right circular cylindrical roller, mounted in an associated bracket 16. However, the guide rollers 15 may be tapered rollers or rollers having a concave or a convex outer surface. The axis of rotation of each guide roller 15 is substantially perpendicular to the axis of rotation of the fixedly-mounted first double-cone roller 10A.

The brackets. 16 are mounted for travel along respective side arms 13 of the framework 12, which are aligned with the side arms 13 which support the corresponding second and third double-cone rollers. The guide rollers 15 are adapted to be moved along their respective side arms in synchronism with their associated moveable double-cone rollers, using hydraulic rams or a mechanically equivalent arrangement.

As will be seen from the upper diagram of FIG. 1(*f*), the three double-cone rollers 10A act to define a hexagonal aperture for a log passing through the equipment. Reverting now to FIG. 3, it will be appreciated that the rollers 10A, 10B and 10C apply pressure to the bark of the log 23, to separate it from the bulk of the wood in the log.

A separate bark cutting roller may be used with this equipment, downstream of the rollers 10A, 10B and 10C. If that is not the case, cutting edges 24 will be provided on each double-cone roller to ensure that the bark is cut, and thus stripped from the log, as the log passes through the equipment.

If required, the mountings of the moveable double-cone rollers 10B and 10C can be mechanically pivoted so that when they reach the upper end of their travel on their respective side-arms 13, they are moved into the position shown in dashed outline in FIG. 3. This pivotal movement is particularly useful if the debarking equipment is to be used as part of a combined tree felling and compression debarking assembly. With such an assembly, the central frame member 19 will be held vertical as a tree is approached and it is desirable to approach a tree with the "jaws" of the assembly as open as possible.

In all practical realisations of the present invention, provision has to be made to ensure that the rollers 10A, 10B, 10C and 15 have sufficient resilience of grip upon the log, as pressure is applied, to prevent the debarker being jammed when the surface topography of a log changes suddenly.

Sudden variations in diameter occur as a result of swellings (usually asymmetrical) in the log and the presence of the stubs of branches. In addition, the roller assemblies should maintain pressure on the log as its diameter reduces (which happens due to the natural taper of the trunks of trees). When (as will be normal practice) hydraulic rams are used to move the roller assemblies and apply pressure to a log, the conventional approach of including an accumulator in the hydraulic circuit will ensure that the rollers adjust to take up the taper in a log and permit the passage of sudden discontinuities in the outer surface of the log. Known pressure-limiting mechanisms can be used with rack and pinion and with worm and nut movement and pressure applying mechanisms, if such mechanisms are used instead of hydraulic rams.

In case jams in the debarking equipment do occur, or to enable a second compression to be applied over a surface region of a log if all the bark is not separated from the wood underneath it, the motors 20 driving the rollers are preferably reversible.

Those skilled in this art will appreciate that although one embodiment of the present invention has been described above, variations to and modifications of this embodiment may be made without departing from the present inventive concept.

We claim:

1. Apparatus for removing bark from a log by a compression debarking action, said apparatus comprising:

a) a framework;

b) a first roller, fixedly mounted on the framework;

c) second and third rollers mounted on the framework for linear movement thereon, said second and third rollers being mounted in spaced apart relationship in the direction of movement of the log through the apparatus, the axis of rotation of each roller being perpendicular to the direction of movement of a log through the apparatus and at an angle of substantially 60° relative to the axes of rotation of each of the other rollers; the first, second and third rollers each being in the form of a double cone, the cones of each roller being tapered towards the middle of the roller;

d) a pair of guide rollers mounted on the framework, each guide roller being associated with a respective one of the double-cone second and third rollers and having its axis of rotation substantially perpendicular to the direction of movement of the log through the equipment and substantially perpendicular to the axis of rotation of the first double-cone roller, each guide roller being adapted for linear movement on the framework in a direction parallel to the direction of movement of the second or third double-cone roller with which it is not associated;

e) movement means to move said second and third rollers and said guide rollers linearly on said framework and to cause said first, second and third rollers and said guide rollers to apply pressure to said log;

f) motor means for rotating said first, second and third rollers; and g) cutting means mounted on each of said rollers to cut the bark of said log.

2. Apparatus as defined in claim 1, in which said framework comprises an elongate central section on which said first roller is mounted and two pairs of frame arms extending from said central section; the arms of each pair of frame arms extending from opposed edges of the central section at right angles thereto to form a generally V-shaped structure; each pair of frame arms supporting one of said second and third rollers on one arm and its associated guide roller on the other arm; respective mounting brackets for said second and third rollers and said guide rollers being moveable along their associated frame arms.

3. Apparatus as defined in claim 2, including means to pivot the mounting brackets of said second and third rollers away from said central section when the second and third rollers are moved to the ends of their respective frame arms remote from said central section.

4. Apparatus as defined in claim 1, in which said motor means comprises a respective reversible hydraulic motor for rotating said first, second and third rollers.

5. Apparatus as defined in claim 1, in which said movement means comprises a respective hydraulic ram associated with each of said second and third rollers and with each of said guide rollers.

6. Apparatus as defined in claim 1, in which said cutting means comprises at least one respective cutting blade projecting from the double-conical surface of each of said first, second and third rollers.

7. Apparatus as defined in claim 1, in which each guide roller is a right cylindrical roller.

8. Apparatus as defined in claim 2, in which said motor means comprises a respective reversible hydraulic motor for rotating said first, second and third rollers, said movement means comprises a respective hydraulic ram associated with each of said second and third rollers and with each of said guide rollers, said cutting means comprises at least one respective cutting blade projecting from the double-conical surface of each of said first, second and third rollers, and each guide roller is a right cylindrical roller.

9. Apparatus as defined in claim 3, in which each of said motor means comprises a respective reversible hydraulic motor for rotating said first, second and third rollers, said movement means comprises a respective hydraulic ram associated with each of said second and third rollers and with each of said guide rollers, said cutting means comprises at least one respective cutting blade projecting from the double-conical surface of each of said first, second and third rollers, and each guide roller is a right cylindrical roller.

* * * * *